US008416165B2

(12) United States Patent
Ahn et al.

(10) Patent No.: US 8,416,165 B2
(45) Date of Patent: Apr. 9, 2013

(54) DISPLAY DEVICE CAPABLE OF RECEIVING AND MANIPULATING IMAGE SIGNALS HAVING DIFFERENT BIT SIZES

(75) Inventors: Ik-Huyn Ahn, Cheonan-si (KR); Woo-Chul Kim, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 718 days.

(21) Appl. No.: 12/466,012

(22) Filed: May 14, 2009

(65) Prior Publication Data

US 2010/0007654 A1 Jan. 14, 2010

(30) Foreign Application Priority Data

Jul. 14, 2008 (KR) ..... 10-2008-0068241

(51) Int. Cl.
*G09G 3/36* (2006.01)

(52) U.S. Cl. ..... 345/87; 345/88

(58) Field of Classification Search ..... 345/204, 345/87, 88, 211, 212, 214; 711/155; 370/395.7, 370/396

See application file for complete search history.

(56) References Cited

U.S. PATENT DOCUMENTS 4,602,275 A * 7/1986 Smith et al. ..... 348/450
2002/0075209 A1* 6/2002 Shigeta ..... 345/87
2005/0001857 A1* 1/2005 Nakakita et al. ..... 345/690
2005/0052386 A1* 3/2005 Kwon et al. ..... 345/87
2006/0061828 A1* 3/2006 Park ..... 358/300
2006/0087696 A1* 4/2006 Lee ..... 358/3.13
2007/0030222 A1* 2/2007 Lee et al. ..... 345/87
2008/0094334 A1* 4/2008 Baek et al. ..... 345/89
2008/0111828 A1* 5/2008 Ahn et al. ..... 345/605
2009/0002043 A1* 1/2009 Kris ..... 327/175

FOREIGN PATENT DOCUMENTS

JP 2003108056 4/2003
JP 2004053698 2/2004
KR 1020040012952 2/2004

* cited by examiner

*Primary Examiner* — Chanh Nguyen
*Assistant Examiner* — Pegeman Karimi
(74) *Attorney, Agent, or Firm* — H.C. Park & Associates, PLC

(57) ABSTRACT

A display device including a signal processing module which can contribute to the reduction of power consumption and a calorific value is provided. The display device includes a signal processing module and a display panel. The signal processing module includes a memory that is divided into two or more sub-memories that can be powered on separately, and an image signal processor to generate a second image signal from a first image signal using the memory. The display panel displays an image corresponding to the second image signal, and the first image signal has a first bit size or a second bit size less than the first bit size. Power is selectively supplied to the sub-memories according to the bit size of the first image signal.

14 Claims, 12 Drawing Sheets

| RGB | FIRST SUB-MEMORY | SECOND SUB-MEMORY | THIRD SUB-MEMORY |
|---|---|---|---|
| 10bit | ON | ON | ON |
| 8bit | ON | ON | OFF |
| 6bit | ON | OFF | OFF |

| RGB | LSB | FIRST LUT | SECOND LUT | THIRD LUT | FOURTH LUT |
|---|---|---|---|---|---|
| 6bit | · | ON | OFF | OFF | OFF |
| 8bit | 00 | ON | OFF | OFF | OFF |
| | 01 | OFF | ON | OFF | OFF |
| | 10 | OFF | OFF | ON | OFF |
| | 11 | OFF | OFF | OFF | ON |

DISPLAY DEVICE CAPABLE OF RECEIVING AND MANIPULATING IMAGE SIGNALS HAVING DIFFERENT BIT SIZES

CROSS-REFERENCE TO RELATED APPLICATION

This application claims priority from and the benefit of Korean Patent Application No. 10-2008-0068241, filed on Jul. 14, 2008, which is hereby incorporated herein by reference for all purposes as if fully set forth herein.

BACKGROUND OF THE INVENTION

1. Field of the Invention

The present invention relates to a display device, and more particularly, to a display device including a signal processing module that may reduce power consumption and a calorific value.

2. Discussion of the Background

In general, display devices may include a signal processing module, a data driver, and a display panel. The signal processing module may receive a first image signal and may output a number of second image signals. The data driver may receive the second image signals and may provide an image data voltage corresponding to the second image signals. The display panel may display an image corresponding to the second image signals in response to the image data voltage provided by the data driver.

The signal processing module may convert the first image signal into the second image signals, which may be processed by the data driver, and may provide the second image signals to the data driver in order to improve the display quality.

The signal processing module may include a memory, which may be used as a storage space during the conversion of the first image signal into the second image signals. The memory, however, may increase the power consumption or the calorific value of the signal processing module. Even if the signal processing module properly performs its operations, such as providing the second image signals, the signal processing module may not be suitable for use in a display device if the signal processing module consumes too much power or generates too much heat.

Therefore, it may be necessary to develop a signal processing module that can contribute to the reduction of power consumption and a calorific value.

SUMMARY OF THE INVENTION

The present invention provides a display device including a signal processing module that may reduce power consumption and a calorific value.

Additional features of the invention will be set forth in the description which follows, and in part will be apparent from the description, or may be learned by practice of the invention.

The present invention discloses a display device including a signal processing module and a display panel. The a signal processing module includes a memory that is divided into two or more sub-memories that can be powered on separately, and an image signal processor to generate a second image signal from a first image signal using the memory. The display panel displays an image corresponding to the second image signal. The first image signal has a first bit size or a second bit size less than the first bit size, and power is selectively supplied to the sub-memories according to the bit size of the first image signal.

The present invention also discloses a display device including a signal processing module and a display panel. The signal processing module includes a memory that is divided into two or more sub-memories that can be powered on separately, and an image signal processor to generate a second image signal from a first image signal using the memory. The display panel displays an image corresponding to the second image signal. The first image signal has a first bit size or a second bit size. The first bit size is 2i where i is a natural number, and the second bit size is 2(i-j) where j is a natural number less than i. The two or more sub-memories include a first sub-memory to store 2(i-j)-bit data and at least one other sub-memory to store 2j-bit data. Power is selectively supplied to the two or more sub-memories according to the bit size of the first image signal.

The present invention also provides a display device including a signal processing module and a display panel. The signal processing module includes a memory that is divided into two or more sub-memories that can be powered on separately, and an image signal processor to generate a second image signal from a first image signal using the memory. The display panel displays an image corresponding to the second image signal. The first image signal has a first bit size or a second bit size less than the first bit size. The first bit size is k, and the second bit size is (k-2) where k is a natural number greater than 2. The memory stores k-bit data, and each of the two or more sub-memories stores (k-2)-bit data. Power is selectively supplied to the two or more sub-memories according to the bit size of the first image signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

FIG. 6A shows a block diagram of the memory for frequency dividing shown in FIG. 1.

FIG. 6B shows a table showing the relationship between the size in bits of a first image signal and the corresponding sub-memories shown in FIG. 6A that are turned on.

FIG. 10A shows a block diagram of an accurate color capture (ACC) memory shown in FIG. 8.

FIG. 10B shows a table showing the relationship between the size in bits and the least significant bits (LSBs) of a first image signal and the corresponding sub-memories shown in FIG. 10A that are turned on.

DETAILED DESCRIPTION OF THE ILLUSTRATED EMBODIMENTS

Figure 1:
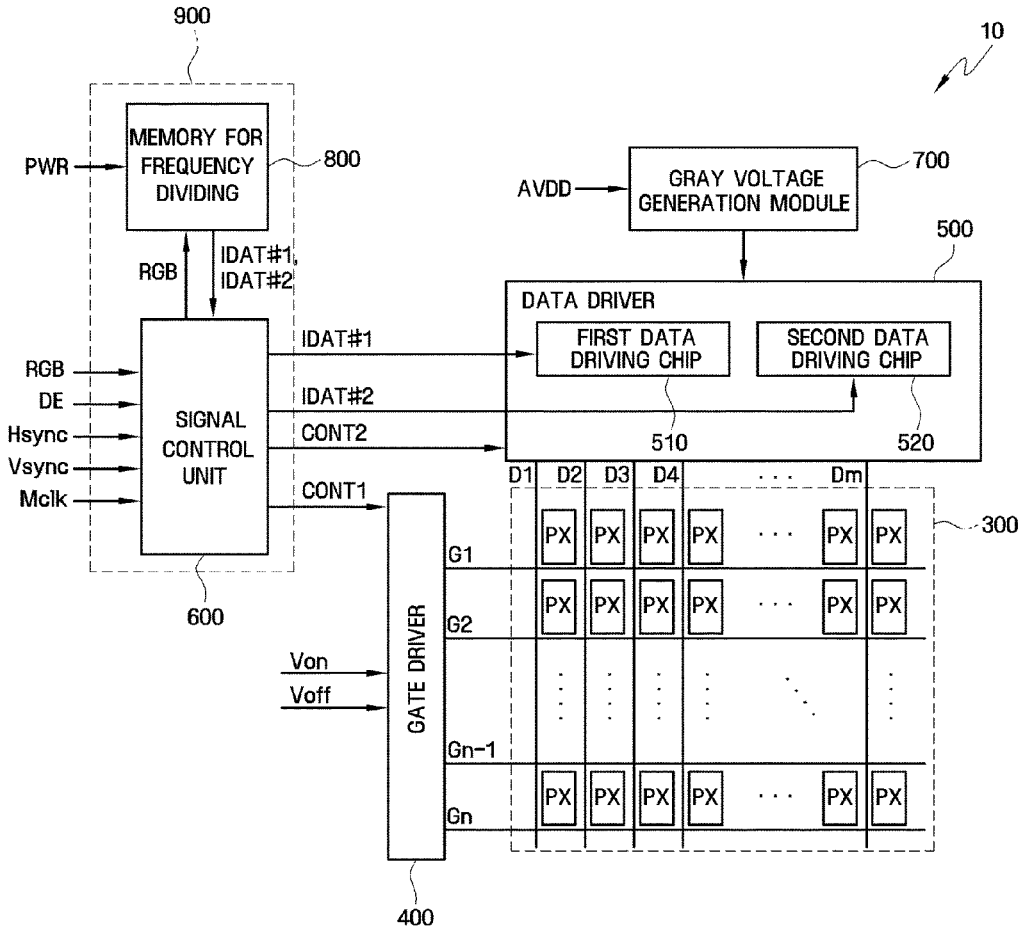
FIG. 1 shows a block diagram of a display device according to a first exemplary embodiment of the present invention.

The present invention will now be described more fully with reference to the accompanying drawings, in which exemplary embodiments of the invention are shown. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers refer to like elements throughout. As used herein the term "and/or" includes any and all combinations of one or more of the associated listed items.

It will be understood that, although the terms first, second, etc. may be used herein to describe various elements, components, regions, layers, and/or sections, these elements, components, regions, layers and/or sections should not be limited by these terms. These terms are only used to distinguish one element, component, region, layer, or section from another element, component, region, layer, or section.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "beneath," or "lower," "above," and "upper" may be used herein to describe one element's relationship to another element as illustrated in the accompanying drawings. It will be understood that relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements.

A display device according to a first exemplary embodiment of the present invention will hereinafter be described in detail with reference to FIG. 1, FIG. 2, FIG. 3, FIG. 4, FIG. 5, FIG. 6, and FIG. 7. In the first exemplary embodiment, a memory for frequency dividing may be used, and second image signals IDAT#1 and IDAT#2 may be transmitted to first and second data driving chips 510 and 520, respectively.

Figure 2:
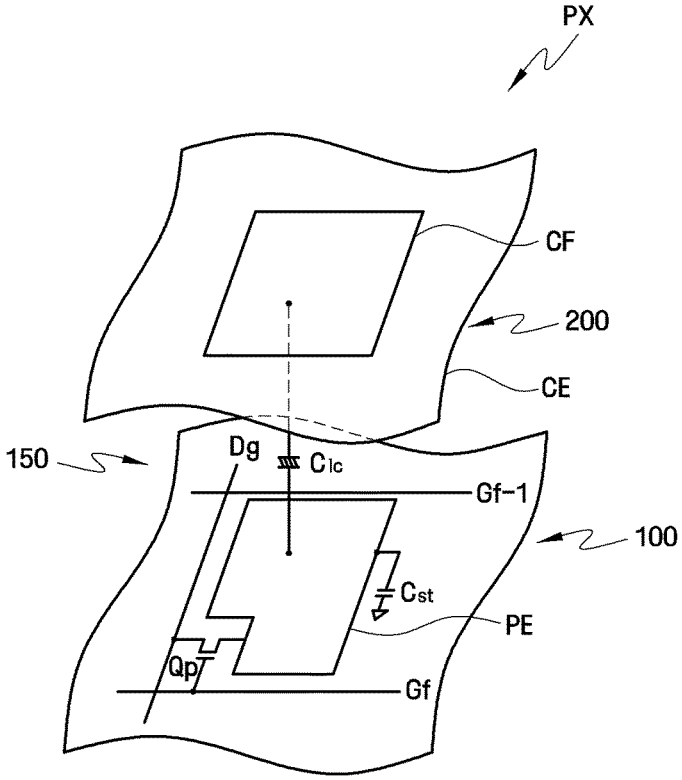
FIG. 2 shows an equivalent circuit diagram of a pixel of the display panel shown in FIG.1.

FIG. 1 shows a block diagram of a display device 10 according to the first exemplary embodiment of the present invention, and FIG. 2 shows an equivalent circuit diagram of a pixel PX of a display panel 300 shown in FIG. 1.

Referring to FIG. 1, the LCD 10 includes a display panel 300, a signal processing module 900, a gate driver 400, a data driver 500, and a gray voltage generation module 700.

The display panel 300 includes a plurality of gate lines G1 through Gn, a plurality of data lines D1 through Dm, and a plurality of pixels PX. The gate lines G1 through Gn extend in a column direction and are parallel with one another, and the data lines D1 through Dm extend in a row direction and are parallel with one another. The pixels PX are defined by crossings of the gate lines G1 through Gn and the data lines D1 through Dm. A gate signal may be applied to each gate line G1 through Gn by the gate driver 400, and an image data voltage may be applied to each data line D1 through Dm by the data driver 500. Each pixel PX displays an image in response to the image data voltage.

The signal processing module 900 may output the second image signals IDAT#1 and IDAT#2 to the data driver 500. The data driver 500 may output an image data voltage corresponding to the second image signals IDAT#1 and IDAT#2. Each pixel PX displays an image in response to a corresponding image data voltage, and may thus be able to display an image corresponding to the second image signals IDAT#1 and IDAT#2.

The pixels PX of the display panel 300 may be arranged in a matrix, and may be divided into a plurality of pixel groups. The data driver 500 may include a plurality of data driving chips, i.e., the first and second data driving chips 510 and 520, respectively corresponding to the pixel groups. A plurality of pixels PX included in each pixel group may display an image corresponding to the second image signals IDAT#1 and IDAT#2 in response to an image data voltage provided by one of the first and second data driving chips 510 and 520.

Referring to FIG. 2, a pixel PX, which is connected to an $f^{th}$ gate line Gf($1 \leqq f \leqq n$) and a $g^{th}$ data line Dg ($1 \leqq g \leqq m$), includes a switching element Qp, which is connected to the $f^{th}$ gate line Gf and the $g^{th}$ data line Dg, and a liquid crystal capacitor $C_{lc}$ and a storage capacitor $C_{st}$, which are both connected to the switching element Qp. The liquid crystal capacitor $C_{lc}$ includes a pixel electrode PE, which is formed on the first display panel 100, a common electrode CE, which is formed on the second display panel 200, and liquid crystal molecules 150, which are disposed between the pixel electrode PE and the common electrode CE. A color filter CF may be formed on the second display panel 200.

Referring back to FIG. 1, the signal processing module 900 may include a signal control unit 600 and a memory for frequency dividing 800. The signal processing module 900 may be a single chip.

The signal control unit 600 receives a first image signal RGB and a plurality of external control signals DE, Hsync, Vsync, and Mclk to control the display of the first image signal RGB, and may output the second image signals IDAT#1 and IDAT#2, a gate control signal CONT1, and a data control signal CONT2.

More specifically, the signal control unit 600 may receive the first image signal RGB, and may output the second image signals IDAT#1 and IDAT#2. The signal control unit 600 may transmit the first image signal RGB to the memory for frequency dividing 800, which may convert the first image signal RGB into the second image signals IDAT#1 and IDAT#2 and output the second image signals IDAT#1 and IDAT#2 to the signal control unit 600. The signal control unit 600 then outputs the second image signals IDAT#1 and IDAT#2 to the data driver 500, which processes the second image signals IDAT#1 and IDAT#2.

The signal control unit 600 may receive the external control signals Vsync, Hsync, Mclk, and DE and generate the data control signal CONT2 and the gate control signal CONT1. The external control signals Vsync, Hsync, Mclk, and DE include a vertical synchronization signal Vsync, a horizontal synchronization signal Hsync, a main clock signal Mclk, and a data enable signal DE. The gate control signal CONT1 is a signal to control the operation of the gate driver 400, and the data control signal CONT2 is a signal to control the operation of the data driver 500. The signal control unit 600 will be described below in further detail with reference to FIG. 3 and FIG. 4.

The signal processing module 900 may also include the memory for frequency dividing 800, which can be used as a storage space during the conversion of the first image signal RGB into the second image signals IDAT#1 and IDAT#2. As described above, the display panel 300 may include a plurality of pixels PX, which are arranged in a matrix. The memory for frequency dividing 800 may store the first image signal RGB, which corresponds to the pixels per each row of the matrix. The memory for frequency dividing 800 may be driven by a power PWR, which is provided by an external power source. The memory for frequency dividing 800 will be described below in further detail with reference to FIG. 4, FIG. 5, FIG. 6, and FIG. 7.

The gate driver 400 is provided with the gate control signal CONT1 by the signal processing module 900, and applies a gate signal to the gate lines G1 through Gn. The gate signal may include the combination of a gate-on voltage Von and a gate-off voltage Voff, which are provided by a gate-on/off voltage generation module (not shown).

The data driver 500 is provided with the data control signal CONT2 by the signal processing module 900, and applies an image data voltage corresponding to the second image signals IDAT#1 and IDAT#2 to the data lines D1 through Dm. The image data voltage corresponding to the second image signals IDAT#1 and IDAT#2 may be provided by the gray voltage generation module 700.

The data driver 500 may include the first and second data driving chips 510 and 520. Each of the first and second data driving chips 510 and 520 may provide an image data voltage to a corresponding pixel group of the display panel 300.

The gray voltage generation module 700 may generate an image data voltage by dividing a driving voltage AVDD according to the grayscale level of the second image signals IDAT#1 and IDAT#2, and may provide the generated image data voltage. The gray voltage generation module 700 may include a plurality of resistors that are connected in series between a ground and a node, to which the driving voltage AVDD is applied, and may thus generate a plurality of gray voltages by dividing the driving voltage AVDD. The gray voltage generation module 700, however, may be implemented using various other structures.

Figure 3:
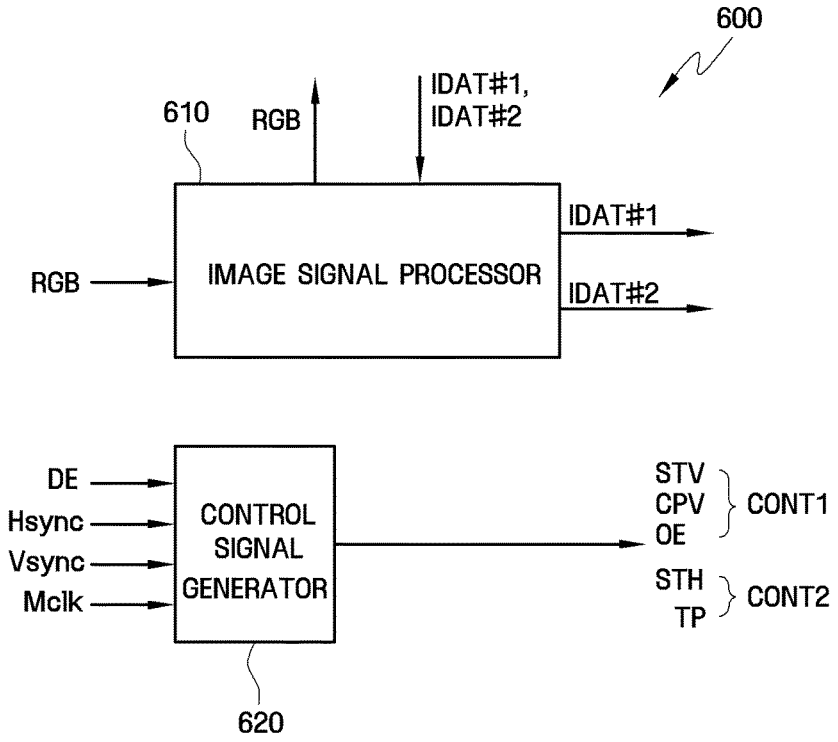
FIG. 3 shows a block diagram of a signal control unit shown in FIG. 1.

FIG. 3 shows a block diagram of the signal control unit 600. Referring to FIG. 3, the signal control unit 600 may include an image signal processor 610 and a control signal generator 620.

The image signal processor 610 may read the first image signal RGB corresponding to each line of pixels PX from the memory for frequency dividing 800, and may transmit second image signals IDAT#1 and IDAT#2 to the first and second data driving chips 510 and 520, respectively.

The image signal processor 610 may generate second image signals IDAT#1 and IDAT#2 from a first image signal RGB using the memory for frequency dividing 800. The first image signal RGB has a first bit size or a second bit size being less than the first bit size. The first bit size may be 2i where i is a natural number, and the second bit size may be 2(1-j) where j is a natural number less than i.

For example, the image signal processor 610 may be able to process a 10-bit first image signal RGB and an 8-bit first image signal RGB. However, the size in bits of a first image signal RGB that can be processed by the image signal processor 610 is not restricted to this. That is, the image signal processor 610 may be able to process an 8-bit first image signal RGB and a 6-bit first image signal RGB. Alternatively, the image signal processor 610 may be able to process a 10-bit first image signal RGB, an 8-bit first image signal RGB and a 6-bit first image signal RGB. In the exemplary embodiment of FIG. 1, FIG. 2, FIG. 3, FIG. 4, FIG. 5, FIG. 6, FIG. 7, the first bit size is 10, and the second bit size is 8 or 6.

Referring back to FIG. 3, the control signal generator 620 may receive the external control signals De, Hsync, Vsync, and Mclk and may generate the data control signal CONT2 and the gate control signal CONT1. The gate control signal CONT1 is a signal to control the operation of the gate driver 400. The gate control signal CONT1 may include a vertical initiation signal STV to initiate the operation of the gate driver 400, a gate clock signal CPV to determine when to output the gate-on voltage Von, and an output enable signal OE to determine the pulse width of the gate-on voltage Von. The data control signal CONT2 may include a horizontal initiation signal STH to initiate the operation of the data driver 500 and an output instruction signal TP to provide instructions to output an image data voltage.

Figure 4:
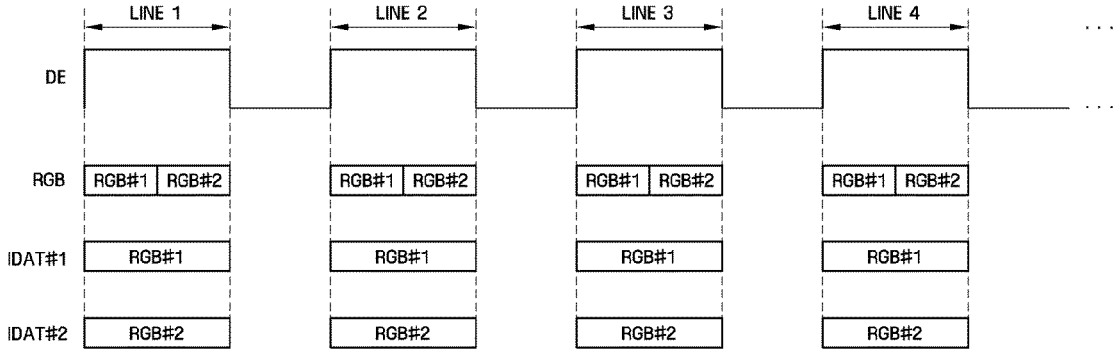
FIG. 4 shows a diagram of the frequency-division of the first image signal of FIG. 1 to second image signals.
Figure 5:
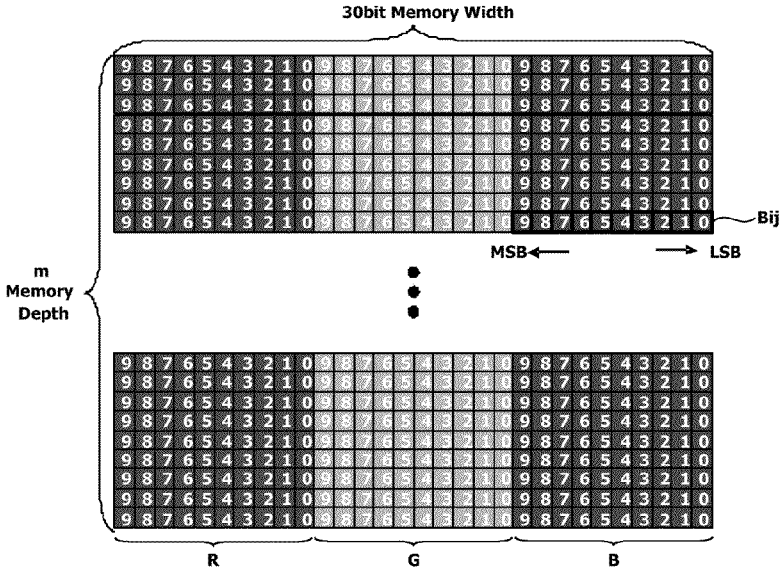
FIG. 5 shows a diagram of the required storage capacity of the memory for frequency dividing shown in FIG. 1.

FIG. 4 shows a diagram of the frequency-division of the first image signal RGB to second image signals, and FIG. 5 shows a diagram of the required storage capacity of the memory for frequency dividing 800 shown in FIG. 1.

Referring to FIG. 4, each period when the data enable signal DE of FIG. 1 is logic-high corresponds to a period when the first image signal RGB is applied to a row of pixels (first through $n^{th}$ rows of the display panel 300). The pixels PX of the display panel 300 may be divided into a plurality of pixel groups. For example, the pixels PX of the display panel 300 may be divided into first and second pixel groups. The first pixel group may include a plurality of pixels PX on the left side of the display panel 300 and the second pixel group may include a plurality of pixels PX on the right side of the display panel 300. In this case, the first image signal RGB may include a first pixel group image signal RGB#1, which is applied to the first pixel group, and a second pixel group image signal RGB#2, which is applied to the second pixel group.

The first data driving chip 510 of the data driver 500 provides a second image signal IDAT#1 to the first pixel group, and the second data driving chip 520 of the data driver 500 provides a second image signal IDAT#2 to the second pixel group. The second image signal IDAT#1 includes the first pixel group image signal RGB#1, and the second image signal IDAT#2 includes the second pixel group image signal RGB#2.

Each of the first and second driving chips 510 and 520 may read the first image signal RGB, which is stored in the memory for frequency dividing 800, and may thus provide the second image signals IDAT#1 and IDAT#2 including the first pixel group image signal RGB#1 and the second pixel group image signal RGB#2, respectively.

Referring to FIG. 5, the memory for frequency dividing 800 should have a storage capacity of 30×m bits.

More specifically, red (R), green (G), and blue (B) data may all need to be provided to each pixel. If the first bit size is 10, the memory for frequency dividing 800 should have a width of 30 bits. Ten columns of memory cells from the far left of the memory for frequency dividing 800 may be allocated to store R data, ten columns of memory cells in the middle of the memory for frequency dividing 800 may be allocated to store G data, and ten columns of memory cells from the far right of the memory for frequency dividing 800 may be allocated to store B data.

The memory for frequency dividing 800 may store the first image signal RGB per each row of the matrix. Since the pixels PX of the display panel 300 are arranged in a matrix having m lines, the memory for frequency dividing 800 should have a depth of m bits.

Referring to FIG. 5, reference character Bij indicates a B signal. When each image signal is 10 bits long, the highest digit in a series of 10 bit values of an image signal is referred to as a most significant bit (MSB), and the lowest digit in a series of 10 bit values of an image signal is referred to as a least significant bit (LSB).

Figures 6A, 6B:
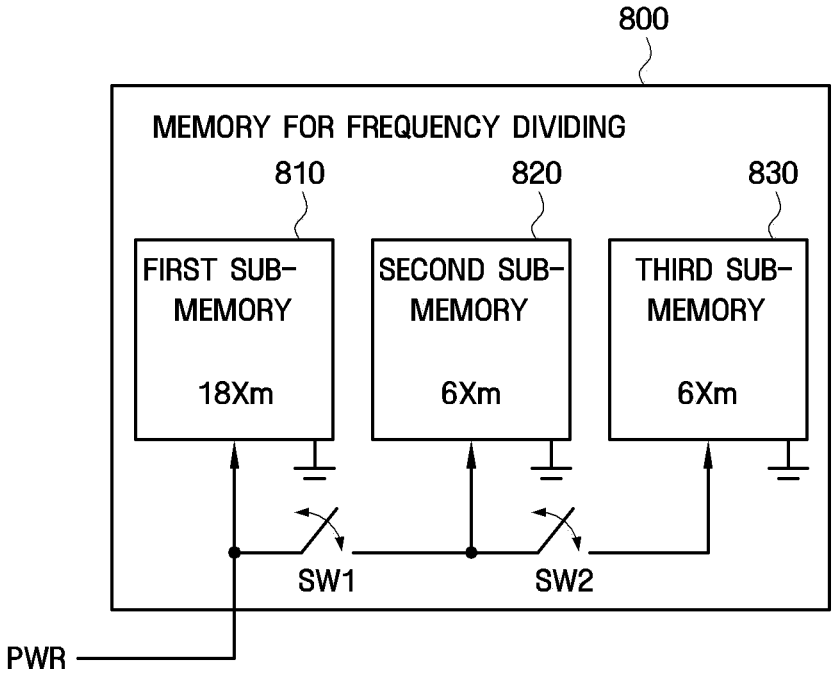
Figure 7:
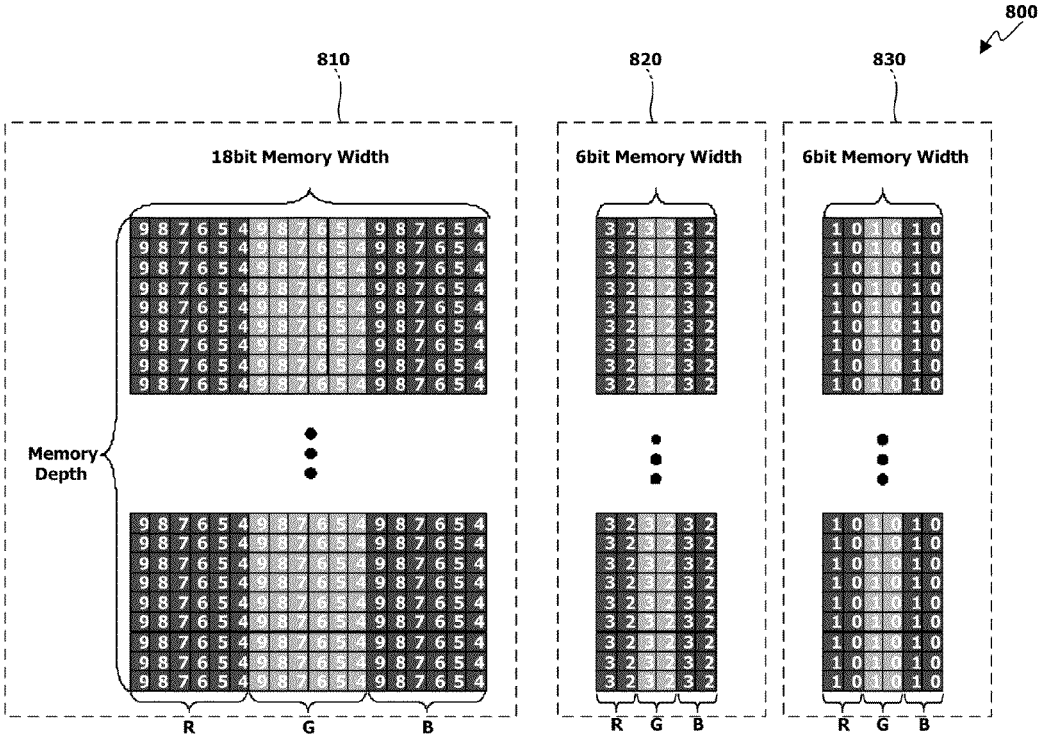
FIG. 7 shows a diagram of the storage capacities of a plurality of sub-memories of the memory for frequency dividing shown in FIG. 1.

FIG. 6A shows a block diagram of the memory for frequency dividing 800 shown in FIG. 5, FIG. 6B shows a table showing the relationship between the size in bits of the first image signal RGB and of the corresponding sub-memories of the memory for frequency dividing 800 that should be powered on, and FIG. 7 shows a diagram of the storage capacities of the sub-memories 810, 820, and 830.

Referring to FIG. 6A, FIG. 6B, and FIG. 7, the memory for frequency dividing 800 may include two or more sub-memories. For example, the memory for frequency dividing 800 may include first, second, and third sub-memories 810, 820, and 830. The first, second, and third sub-memories 810, 820, and 830 may be powered on separately. More specifically, the first, second, and third sub-memories 810, 820, and 830 may be selectively powered on according to the size in bits of the first image signal RGB. Referring to FIG. 6A, the first, second, and third sub-memories 810, 820, and 830 may be selectively powered on using switching devices SW1 and SW2.

The memory for frequency dividing 800 may store the first image signal RGB corresponding to each line of pixels PX. The memory for frequency dividing 800 may include one first sub-memory 810 and at least one other sub-memory. In FIG. 6A, the second and third sub-memories 820 and 830 are the at least one other sub-memory. The first sub-memory 810 may be able to store 2(i-j)-bit data, and the second and third sub-memories 820 and 830 may be able to store 2j-bit data together. For example, each of the second and third sub-memories 820 and 830 may be able to store 2-bit (that is j=1) data.

Referring to FIG. 6A and FIG. 7, the first sub-memory 810 may store 6-bit data, and the second and third sub-memories 820 and 830 together may store 4-bit data. Each of the second and third sub-memories 820 and 830 may store 2-bit data. The first sub-memory 810 may have a storage capacity of 18×m bits so as to be able to store 6-bit data. Each of the second and third sub-memories 820 and 830 may have a storage capacity of 6×m bits so as to be able to store 2-bit data.

Referring to FIG. 6A, if the first image signal RGB of the second bit size is input to the signal processing module 900 shown in FIG. 1, the first sub-memory 810 may be powered on, and second image signals IDAT#1 and IDAT#2 may be output using only the first sub-memory 810.

More specifically, referring to FIG. 6B, if the first bit size is 6, the first sub-memory 810 may be powered on, and second image signals IDAT#1 and IDAT#2 may be output using the first image signal RGB present in the first sub-memory 810. On the other hand, if the second bit size is 8, power may be supplied to the first and second sub-memories 810 and 820, and second image signals IDAT#1 and IDAT#2 may be output using the first image signal RGB present in the first and second sub-memories 810 and 820, respectively. Further, if the second bit size is 10, power may be supplied to the first, second, and third sub-memories 810, 820, and 830 and second image signals IDAT#1 and IDAT#2 may be output using the first image signal RGB present in the first, second, and third sub-memories 810, 820, and 830, respectively.

In short, second image signals IDAT#1 and IDAT#2 may be output by selectively supplying power to the sub-memories 810, 820, and 830 according to the size in bits of the first image signal RGB. Thus, it may be possible to reduce the power consumption and the calorific value of the signal processing module 900.

Display devices according to second and third exemplary embodiments of the present invention will hereinafter be described in detail with reference to FIG. 8, FIG. 9, FIG. 10A, FIG. 10B, FIG. 11, FIG. 12, FIG. 13, and FIG. 14. In the second and third exemplary embodiments, a memory storing data as a lookup table (LUT) may be used. A memory storing data as a LUT will hereinafter be referred to as an accurate color capture (ACC) memory. The second and third exemplary embodiments will hereinafter be described in detail, mainly focusing on how they differ from the first exemplary embodiment.

Figure 8:
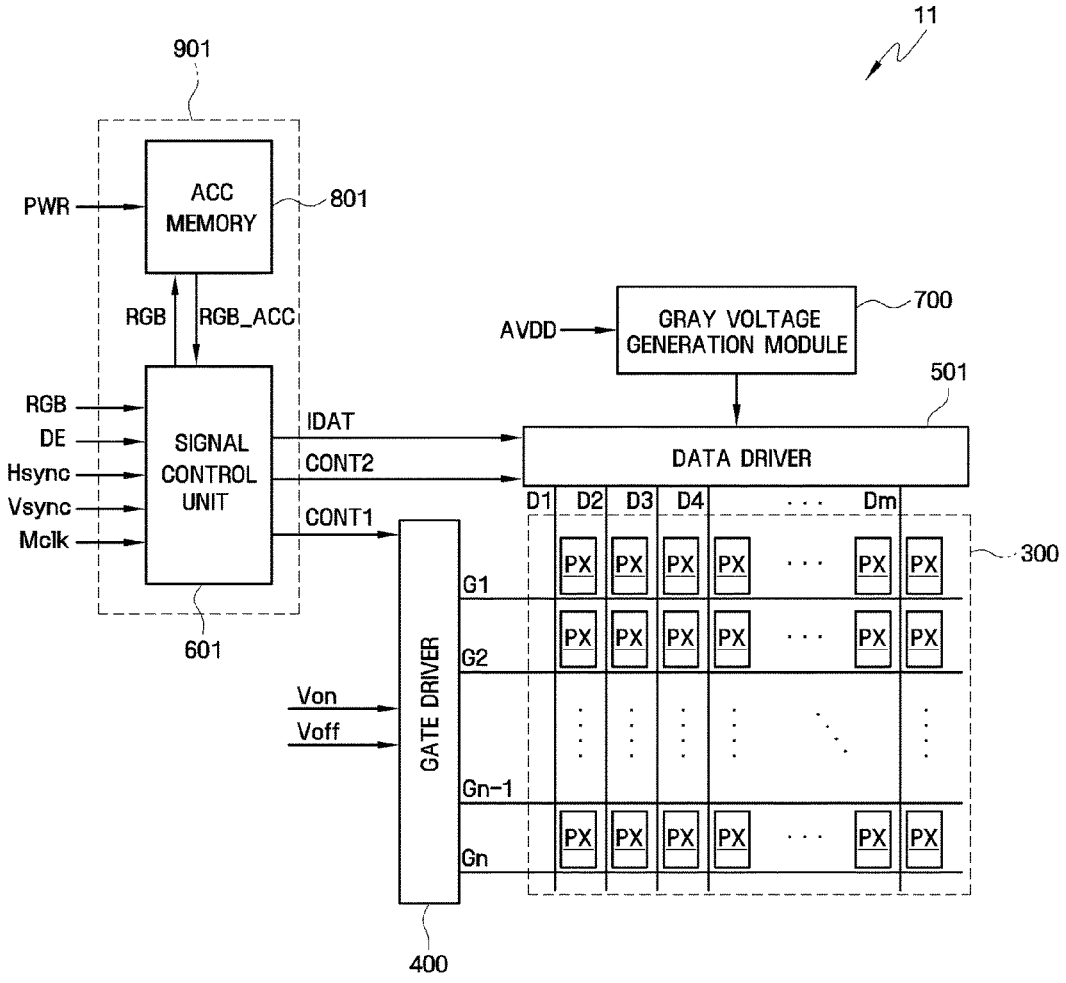
FIG. 8 shows a block diagram of a display device according to second and third exemplary embodiments of the present invention.

FIG. 8 shows a block diagram of a display device 11 according to second and third exemplary embodiments of the present invention. Referring to FIG. 8, the display device 11 includes a display panel 300, a signal processing module 901, a gate driver 400, a data driver 501, and a gray voltage generation module 700.

The display panel 300 may include a plurality of pixels PX. Each pixel PX may display an image in response to an image data voltage provided by the data driver 501. The signal processing module 901 may output a second image signal IDAT to the data driver 501, and each pixel PX may display an image in response to an image data voltage provided by the data driver 501. Thus, the pixels PX may display an image corresponding to the second image signal IDAT.

The signal processing module 901 may include a signal control unit 601 and an ACC memory 801. The signal processing module 901 may be a single chip.

The signal control unit 601 may receive a first image signal RGB and a plurality of external control signals DE, Hsync, Vsync, and Mclk to control the display of the first image signal RGB and may output a second image signal IDAT, a gate control signal CONT1, and a data control signal CONT2.

In order to improve display quality, the signal control unit 601 may convert the first image signal RGB into the second image signal IDAT. The signal control unit 601 may receive the external control signals De, Hsync, Vsync, and Mclk and may generate the gate control signal CONT1 and the data control signal CONT2 based on the external control signals De, Hsync, Vsync, and Mclk. The signal control unit 601 will be described below in further detail with reference to FIG. 9.

The signal processing module 901 may also include the ACC memory 801. The ACC memory 801 may be used as a storage space during the conversion of the first image signal RGB into the second image signal IDAT. The ACC memory 801 may be driven by power PWR provided by an external power source. The ACC memory 801 will be described below in further detail with reference to FIG. 10A and FIG. 10B.

The data driver 501 may receive the data control signal CONT2 from the signal control unit 601, and may apply an image data voltage corresponding to the second image signal IDAT to a plurality of data lines D1 through Dm. The image data voltage corresponding to the second image signal IDAT may be provided by the gray voltage generation module 700.

Figure 9:
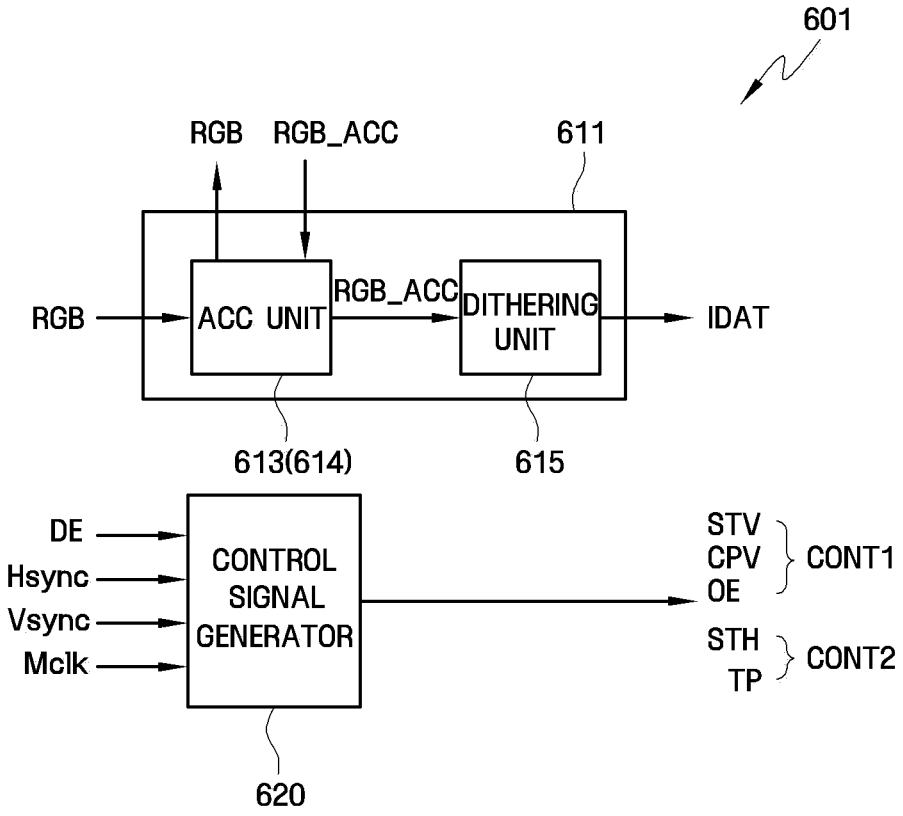
FIG. 9 shows a block diagram of the signal control unit shown in FIG. 8.

FIG. 9 shows a block diagram of the signal control unit 601 shown in FIG. 8. Referring to FIG. 9, the signal control unit 601 may include an image signal processor 611 and a control signal generator 620.

The image signal processor 611 may generate a second image signal IDAT from a first image signal RGB using the ACC memory 801. The first image signal RGB has a first bit size or a second bit size being less than the first bit size. The first bit size may be k where k is a natural number greater than 2, and the second bit size may be (k-2).

For example, the image signal processor 611 may be able to process a 10-bit first image signal RGB and an 8-bit first image signal RGB. However, the size in bits of a first image signal RGB that can be processed by the image signal processor 611 is not restricted to this. That is, the image signal processor 611 may be able to process an 8-bit first image signal RGB and a 6-bit first image signal RGB. Alternatively, the image signal processor 611 may be able to process a 10-bit first image signal RGB, an 8-bit first image signal RGB, and a 6-bit first image signal RGB. In the exemplary embodiments of FIG. 8, FIG. 9, FIG. 10A, FIG. 10B, FIG. 11, FIG. 12, FIG. 13, and FIG. 14, the first bit size is 8, and the second bit size is 6.

The image signal processor 611 may receive conversion data RGB_ACC corresponding to the first image signal RGB from the ACC memory 801, and may provide the second image signal IDAT, which is obtained by correcting the first image signal RGB. The image signal processor 611 may access one of a plurality of sub-memories 811, 821, 831, and 841 of the ACC memory 801 with reference to the LSB(s) of the first image signal RGB, may read conversion data RGB_ACC from the accessed sub-memory, and may generate the second image signal IDAT using the conversion data RGB_ACC. This will be described below in further detail with reference to FIG. 11 and FIG. 12.

The image signal processor 611 may include an ACC unit 613 and a dithering unit 615.

The ACC unit 613 may receive the first image signal RGB, may receive the conversion data RGB_ACC from the ACC memory 801, and may output the conversion data RGB_ACC to the dithering unit 615. The dithering unit 615 may obtain the second image signal IDAT by dithering the first image signal RGB based on the conversion data RGB_ACC.

The conversion data RGB_ACC is a signal to correct the first image signal RGB. For example, the conversion data RGB_ACC may be substantially the same as the second image signal IDAT, which is obtained by correcting the first image signal RGB. In this case, the ACC unit 613 may be a memory controller that reads the conversion data RGB_ACC from the ACC memory 801 and provides the conversion data RGB_ACC to the dithering unit 615. In the exemplary embodiments of FIG. 8, FIG. 9, FIG. 10A, FIG. 10B, FIG. 11, FIG. 12, FIG. 13, and FIG. 14, the conversion data RGB_ACC is substantially the same as the second image signal IDAT, and the ACC unit 613 is a memory controller. The ACC unit 613 will be described below in further detail with reference to FIG. 13, and the dithering unit 615 will be described below in further detail with reference to FIG. 14.

Figures 10A, 10B:
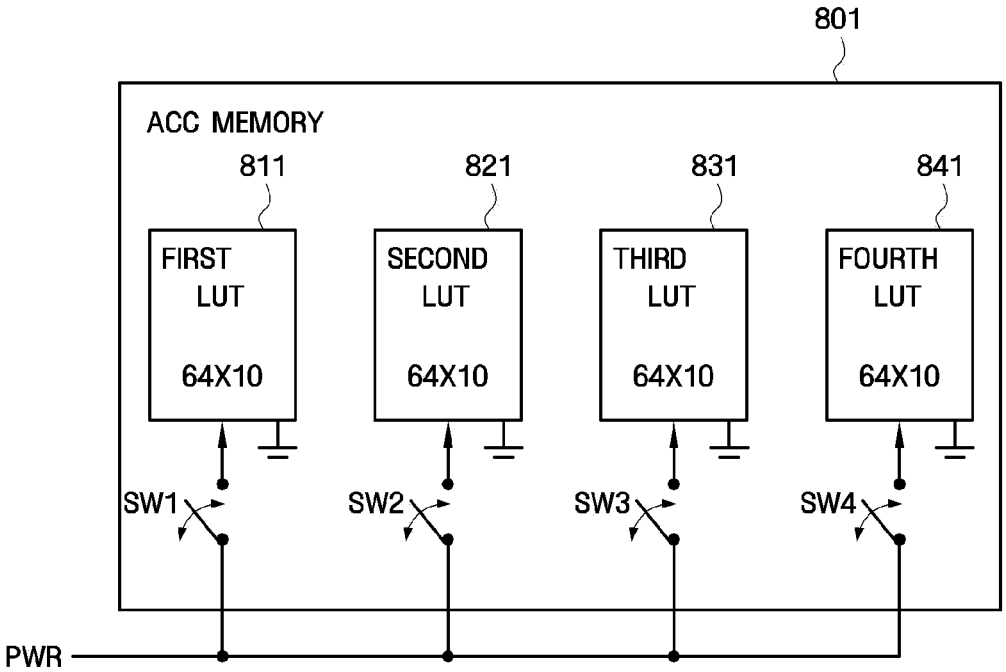

FIG. 10A shows a block diagram of the ACC memory 801 shown in FIG. 8, and FIG. 10B shows a table showing the relationship between the size in bits and the LSBs of the first image signal RGB and which of the first, second, third, and fourth sub-memories 811, 821, 831, and 841 of the ACC memory 801 should be powered on.

Referring to FIG. 10A and FIG. 10B, the ACC memory 801 may include two or more sub-memories. For example, the ACC memory 801 may include first, second, third, and fourth sub-memories 811, 821, 831, and 841. The first, second, third, and fourth sub-memories 811, 821, 831, and 841 may be powered on separately. More specifically, the first, second, third, and fourth sub-memories 811, 821, 831, and 841 may be selectively powered on according to the size in bits of the first image signal RGB. Referring to FIG. 10A, the first, second, third, and fourth sub-memories 811, 821, 831, and 841 may be powered on separately by using switching devices SW1, SW2, and SW3.

The ACC memory 801 may store the conversion data RGB_ACC, which distorts the gamma property of the first image signal RGB, as a LUT.

Referring to FIG. 9, the image signal processor 611 may read the conversion data RGB_ACC corresponding to the first image signal RGB from the ACC memory 801, and may expand the bit size of the first image signal RGB using the conversion data RGB_ACC.

The ACC memory 801 may be able to store data having the first bit size, i.e., k-bit data, and each of the first, second, third, and fourth sub-memories 811, 821, 831, and 841 of the ACC memory 801 may be able to store (k-2)-bit data. For purposes of explanation, it is assumed that k=8.

Each of the first, second, third, and fourth sub-memories 811, 821, 831, and 841 may have a storage capacity of 64×10. Therefore, the ACC memory 801 may have a total storage capacity of 256×10. The size in bits of the first image signal RGB is 8, and the size in bits of the conversion data RBG_ACC is 10. Thus, the ACC memory 801 may be able to store 10-bit conversion data RBG_ACC corresponding to an 8-bit first image signal RGB. In this manner, the size in bits of the first image signal RGB may be increased from 8 to 10 by reading the conversion data RGB_ACC corresponding to the first image signal RGB from the ACC memory 801.

Referring to FIG. 10A, when the first image signal RGB having the first bit size is input to the signal processing module 901 shown in FIG. 8, the second image signal IDAT may be generated by supplying power only to one of the first, second, third, and fourth sub-memories 811, 821, 831, and 841 of the ACC memory 801.

More specifically, referring to FIG. 10B, if the first bit size is 6, the first sub-memory 811 may be powered on, and thus, the second image signal IDAT may be generated using a first LUT present in the first sub-memory 811. If the second bit size is 8, the second image signal IDAT may be generated by selectively powering on the first, second, third, and fourth sub-memories 811, 821, 831, and 841 with reference to the least and second-least significant bits of the first image signal RGB.

For example, if the least and second-least significant bits of the first image signal RGB are 00, the first sub-memory 811 may be powered on, and thus, the second image signal IDAT may be generated using the first LUT present in the first sub-memory 811. If the least and second-least significant bits of the first image signal RGB are 01, power may be supplied only to the second sub-memory 821, and thus, the second image signal IDAT may be generated using a second LUT present in the second sub-memory 821. If the least and second-least significant bits of the first image signal RGB are 10, the third sub-memory 831 may be powered on, and thus, the second image signal IDAT may be generated using a third LUT present in the third sub-memory 831. If the least and second-least significant bits of the first image signal RGB are 11, the fourth sub-memory 841 may be powered on, and thus, the second image signal IDAT may be generated using a fourth LUT present in the fourth sub-memory 841.

In short, the second image signal may be generated by selectively powering on the first, second, third, and fourth sub-memories 811, 821, 831, and 841 according to the size in bits of the first image signal RGB. Therefore, it may be possible to reduce the power consumption and the calorific value of the signal processing module 901.

It will hereinafter be described in detail how to selectively supply power to the first, second, third, and fourth sub-memories 811, 821, 831, and 841 based on the LSB(s) of the first image signal RGB with reference to FIG. 11 and FIG. 12.

Figure 11:
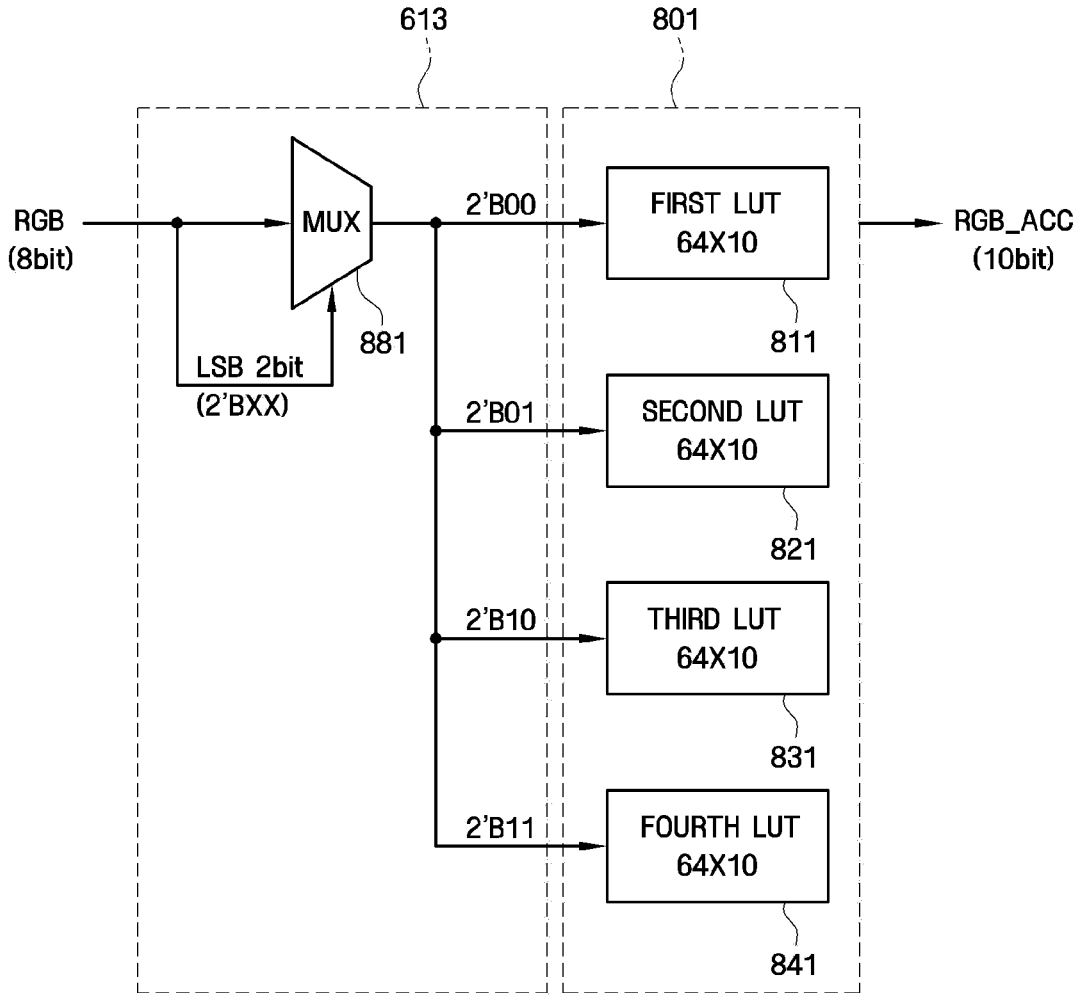
FIG. 11 shows a block diagram of the reading of conversion data from the ACC memory shown in FIG. 10A by an ACC unit shown in FIG. 9 of a display device according to the second exemplary embodiment of the present invention.

FIG. 11 shows a block diagram of the reading of the conversion data RGB_ACC from the ACC memory 801 shown in FIG. 10A by the ACC unit 613 shown in FIG. 9 of a display device according to the second exemplary embodiment of the present invention.

Referring to FIG. 11, the ACC unit 613 may read the conversion data RGB_ACC from the ACC memory 801 by accessing one of the first, second, third, and fourth sub-memories 811, 821, 831, and 841 with reference to the LSB(s) of the first image signal RGB. Thereafter, the ACC unit 613 may expand the first image signal RGB by increasing the size in bits of the first image signal RGB, for example, from 8 to 10, using the conversion data RGB_ACC. The expanded first image signal RGB may be contracted to the original size in bits of the first image signal RGB by the dithering unit 615.

The ACC unit 613 may include a multiplexer (MUX) 881. The ACC unit 613 may read the conversion data RGB_ACC from the ACC memory 801 by accessing one of the first, second, third, and fourth sub-memories 811, 821, 831, and 841 using the LSB(s) of the first image signal RGB as a selection signal. In this manner, it may be possible to read the conversion data RGB_ACC from the ACC memory 801 by selectively supplying power to the first, second, third, and fourth sub-memories 811, 821, 831, and 841.

Figure 12:
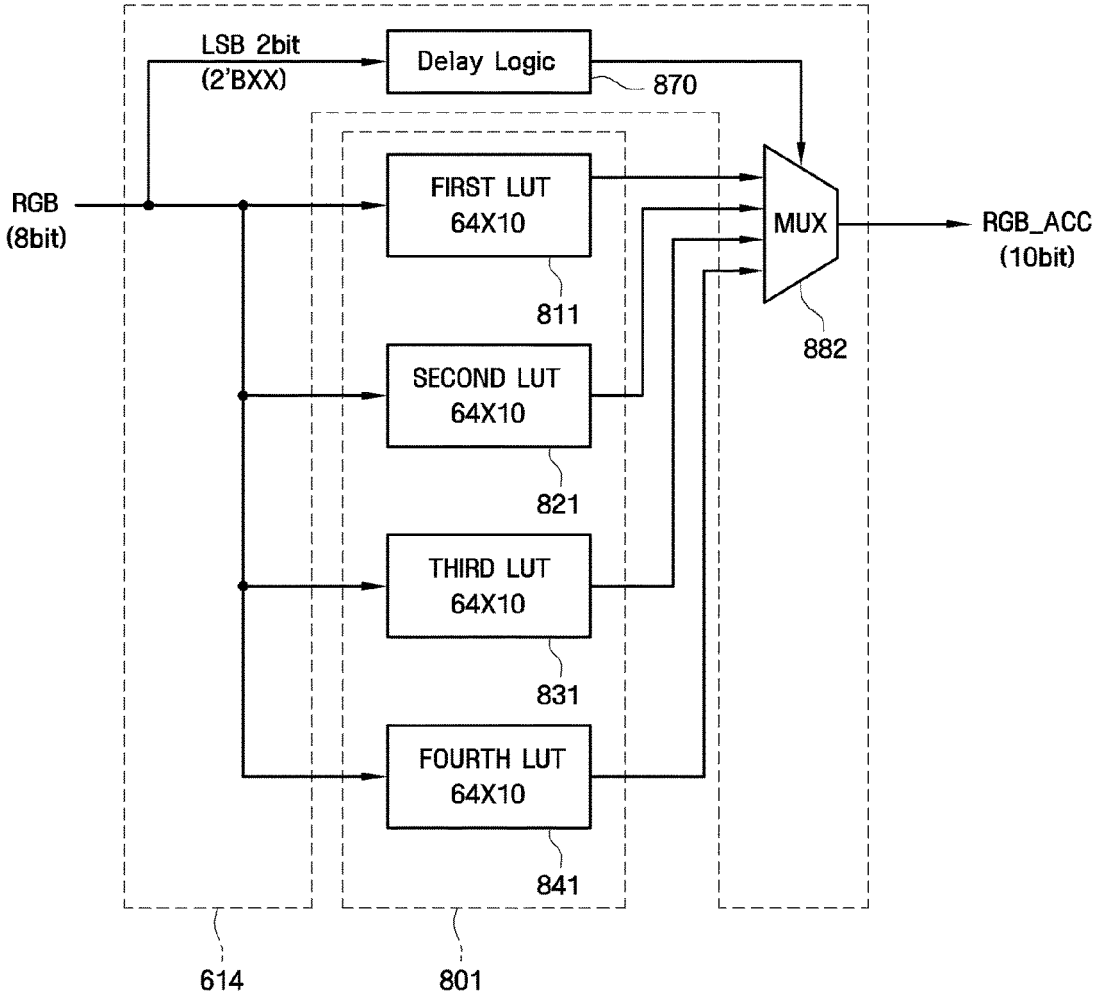
FIG. 12 shows a block diagram of the reading of conversion data from an ACC memory shown in FIG. 10A by an ACC unit shown in FIG. 9 of a display device according to the second exemplary embodiment of the present invention.

FIG. 12 shows a block diagram of the reading of conversion data RGB_ACC from an ACC memory 801 shown in FIG. 10A by an ACC unit 614 shown in FIG. 9 of a display device according to second exemplary embodiment of the present invention. Referring to FIG. 12, the ACC unit 614 may read the conversion data RGB_ACC from the ACC memory 801 by accessing one of first, second, third, and fourth sub-memories 811, 821, 831, and 841 with reference to the LSB(s) of a first image signal RGB.

More specifically, the ACC unit 614 may access each of the first, second, third, and fourth sub-memories 811, 821, 831, and 841 and may thus read data from each of the first, second, third, and fourth sub-memories 811,821,831, and 841. Thereafter, the ACC unit 614 may choose one of the four data respectively read from the first, second, third, and fourth sub-memories 811, 821, 831, and 841 with reference to the LSB(s) of the first image signal RGB, and may output the chosen data as the conversion data RGB_ACC.

The ACC unit 614 may include a MUX 882 and a delay logic circuit 870.

The ACC unit 614 may choose one of the four data respectively read from the first, second, third, and fourth sub-memories 811, 821, 831, and 841 using the LSB(s) of the first image signal RGB as a selection signal, and may output the chosen data as the conversion data RGB_ACC.

The delay logic circuit 870 delays the LSB(s) of the first image signal RGB during the reading of data from each of the first, second, third, and fourth sub-memories 811, 821, 831, and 841. Therefore, it may be possible to choose one of the four data respectively read from the first, second, third, and fourth sub-memories 811, 821, 831, and 841 using the LSB(s) of the first image signal RGB as a selection signal and output the chosen data as the conversion data RGB_ACC.

In this manner, it may be possible to read the conversion data RGB_ACC from the ACC memory 801 by selectively supplying power to the first, second, third, and fourth sub-memories 811, 821, 831, and 841.

The ACC unit 613 or 614 will hereinafter be described in further detail with reference to FIG. 13.

Figure 13:
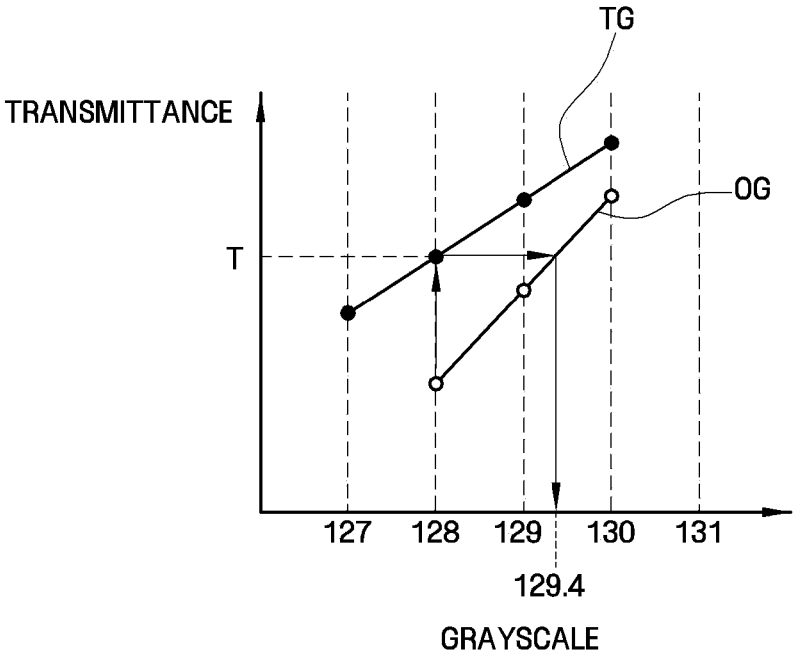
FIG. 13 shows a graph of a gamma conversion operation performed by the ACC unit shown in FIG. 9.

FIG. 13 shows a graph of a gamma conversion operation performed by the ACC unit 613 or 614 shown in FIG. 9. Referring to FIG. 13, the conversion data RGB_ACC corresponds to the first image signal RGB in a one-to-one relationship and may be used to transform the gamma property of the first image signal RGB.

Referring to FIG. 13, an original gamma curve OG indicates the correspondence between the transmittance of the first image signal RGB and the grayscale of the first image signal RGB, and a target gamma curve TG indicates the correspondence between grayscale and target transmittance.

Assume that the first image signal RGB has a grayscale level of 128. The grayscale level of 128 corresponds to a specific transmittance level T on the target gamma curve, and the specific transmittance level T corresponds to a grayscale level of 129.4 on the original gamma curve OG. Thus, the first image signal RGB may be corrected using conversion data RGB_ACC having a grayscale level of 129.4 so that the original gamma curve OG can become the same as the target gamma curve TG. The conversion data RGB_ACC may correspond to the first image signal RGB, and may have a different gamma property from that of the first image signal RGB.

In order to increase the precision of gamma conversion, bit expansion may be performed to express a grayscale level with a number of bits below the decimal point. For example, since the first image signal RGB is 8 bits long and has a grayscale level of 128, the first image signal RGB may be represented as '10000000'. Since the conversion data RGB_ACC has a grayscale level of 129.4, the conversion data RGB_ACC may be represented as '1000000101'by adding two bits to the number of bits of the first image signal RGB. However, the conversion data RGB_ACC may have the same bit size as that of the first image signal RGB. In this case, the dithering unit 615 is optional. It is obvious that the size in bits of the conversion data RGB_ACC may be 10 or more.

The dithering unit 615 shown in FIG. 9 will hereinafter be described in further detail with reference to FIG. 14.

Figure 14:
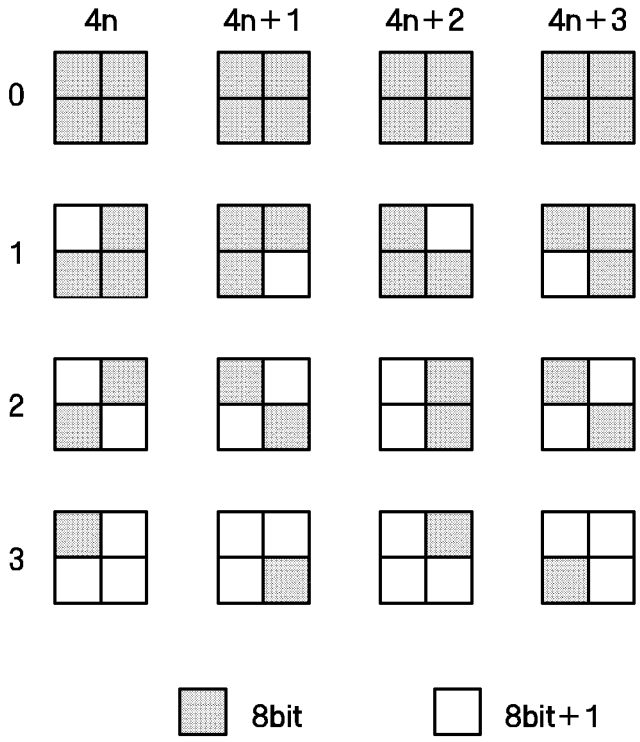
FIG. 14 shows a diagram of the operation of the dithering unit shown in FIG. 9.

FIG. 14 shows a diagram of the operation of the dithering unit 615. Referring to FIG. 14, if the conversion data RGB_ACC is 10 bits long and the second image signal IDAT is 8 bits long, the conversion data RGB_ACC may be divided into two parts. The two parts may include a first part including the upper eight bits of the conversion data RGB_ACC and a second part including the lower two bits of the conversion data RGB_ACC. The lower two bits of the conversion data RGB_ACC may be '00', '01', '10' or '11'. If the lower two bits of the conversion data RGB_ACC are '00', four neighboring pixels may all be represented as '8-bit data'. If the lower two bits of the conversion data RGB_ACC are '01', one of four neighboring pixels may be represented as '8-bit dat+1', and the other three pixels may be represented as '8-bit data'. In order to prevent flickering, the position of the pixel represented as '8-bit data+1' may vary from one frame to another frame, as shown in FIG. 14.

Likewise, if the lower two bits of the conversion data RGB_ACC are '10', two of four neighboring pixels may be represented as '8-bit dat+1', and the other two pixels may be represented as '8-bit data'. If the lower two bits of the conversion data RGB_ACC are '11', three of four neighboring pixels may be represented as '8-bit dat+1', and the other pixel may be represented as '8-bit data'. In order to prevent flickering, the positions of the pixels represented as '8-bit data+1' may vary from one frame to another frame, as shown in FIG. 14.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a signal processing module comprising:

a memory that is divided into two or more sub-memories that can be powered on separately, an image signal processor to receive a first image signal having a first number of bits, and to generate a second image signal from the first image signal using the memory, the image signal processor being configured to receive another first image signal having a second number of bits, the second number being smaller than the first number, and a switching unit to selectively supply power to the two or more sub-memories based on a number of bits of the first image signal; and a display panel to display an image corresponding to the second image signal, wherein the switching unit is configured to supply power to the two or more sub-memories in response to the first image signal having the first number of bits, and to cut off power supply to at least one of the two or more sub-memories in response to the first image signal having the second number of bits.

2. The display device of claim 1, wherein the signal processing module is a single chip.

3. The display device of claim 1, wherein:

the first bit size is 2i where i is a natural number; and the second bit size is 2(i-j) where j is a natural number less than i.

4. The display device of claim 3, wherein the memory comprises a first sub-memory to store 2(i-j)-bit data and at least one other sub-memory to store 2j-bit data.

5. The display device of claim 1, wherein:

the first number of bits is k;

the second number of bits is (k-2);

the memory is configured to store k-bit data; and each sub-memory is configured to store (k-2)-bit data.

6. The display device of claim 5, wherein the image signal processor is configured to read data from the memory by accessing one of the sub-memories with reference to a least significant bit (LSB) of the first image signal, and output the second image signal using the read data.

7. A display device, comprising:

a signal processing module comprising:

a memory that is divided into two or more sub-memories that can be powered on separately, an image signal processor to receive a first image signal having a first number of bits, and to generate a second image signal from the first image signal using the memory, the image signal processor being configured to receive another first image signal having a second number of bits, the second number being smaller than the first number of bits, and a switching circuit to selectively supply power to the two or more sub-memories according to a number of bits of the first image signal; and a display panel to display an image corresponding to the second image signal, wherein the first number of bits is k and the second number of bits is (k-2) where k is a natural number greater than 2, the memory is configured to store k-bit data, each of the two or more sub-memories is configured to store (k-2)-bit data, and the switching circuit is configured to supply power to the two or more sub-memories when the first image signal has the first number of bits, and to supply power to some, but not all, of the two or more sub-memories when the first image signal has the second number of bits.

8. The display device of claim 7, wherein the signal processing module is a single chip.

9. The display device of claim 7, wherein, if the first image signal of the second number of bits is input to the signal processing module, the second image signal is generated using one of the two or more sub-memories and output by supplying power to the one of the two or more sub-memories.

10. The display device of claim 7, wherein:

the memory is configured to store accurate color capture (ACC) conversion data, which distorts the gamma property of the first image signal, as a lookup table; and the image signal processor is configured to read the ACC conversion data corresponding to the first image signal from the memory and expand the number of bits of the first image signal using the ACC conversion data.

11. The display device of claim 10, wherein the image signal processor comprises a dithering unit to contract the expanded number of bits to the original number of bits of the first image signal and output the second image signal.

12. The display device of claim 7, wherein the image signal processor is configured to read data from the memory by accessing one of the two or more sub-memories with reference to a least significant bit (LSB) of the first image signal, and output the second image signal using the read data.

13. The display device of claim 7, wherein the image signal processor is configured to read data from each of the two or more sub-memories by accessing each of the two or more sub-memories, choose one of the data respectively read from the two or more sub-memories with reference to an LSB of the first image signal, and output the second image signal using the chosen data.

14. The display device of claim 13, wherein the image signal processor comprises a delay logic circuit to delay the LSB of the first image signal during the reading of data from each of the two or more sub-memories.

* * * * *